United States Patent [19]

Aebi

[11] 3,976,185

[45] Aug. 24, 1976

[54] TYPEWRITER RIBBON CONVEYING MECHANISM

[75] Inventor: Otto Aebi, Yverdon, Switzerland

[73] Assignee: Hermes Precisa International S.A., Yverdon, Switzerland

[22] Filed: Nov. 18, 1974

[21] Appl. No.: 525,017

[30] Foreign Application Priority Data

Nov. 20, 1973 Switzerland ..... 16318/73

[52] U.S. Cl. ..... 197/162

[51] Int. Cl.[2] ..... B41J 33/48

[58] Field of Search ..... 197/151, 160, 162, 165, 197/168; 101/336

[56] References Cited

UNITED STATES PATENTS

| | | | |
|---|---|---|---|
| 2,505,991 | 5/1950 | Reinhold | 197/162 |
| 2,906,203 | 9/1959 | Grosse | 197/162 X |
| 2,978,090 | 4/1961 | Brandt | 197/162 |
| 3,011,434 | 12/1961 | Schenk | 197/162 X |
| 3,752,290 | 8/1973 | Langheinrich | 197/162 |
| 3,793,951 | 2/1974 | Denley | 197/168 X |

*Primary Examiner*—Anton O. Oechsle
*Attorney, Agent, or Firm*—Emory L. Groff, Jr.

[57] ABSTRACT

A ribbon cassette support is pivotally mounted on the printing head carriage of a typewriter. The support includes driving pawls for driving the cassette hubs and a member selectively disengaging one pawl from one hub to allow driving of the other hub by the other pawl in a direction to wind on the ribbon. When the ribbon is fully wound out from said one hub, the continuing action of the driving pawl on the other hug tips the cassette support to a new position in which the control member engages said one pawl and disengages the other, thereby reversing the direction of drive of the ribbon. The cassette support and control member are connected by a spring simultaneously biasing both the support and the member into one of two stable positions.

4 Claims, 3 Drawing Figures

Figure 1:
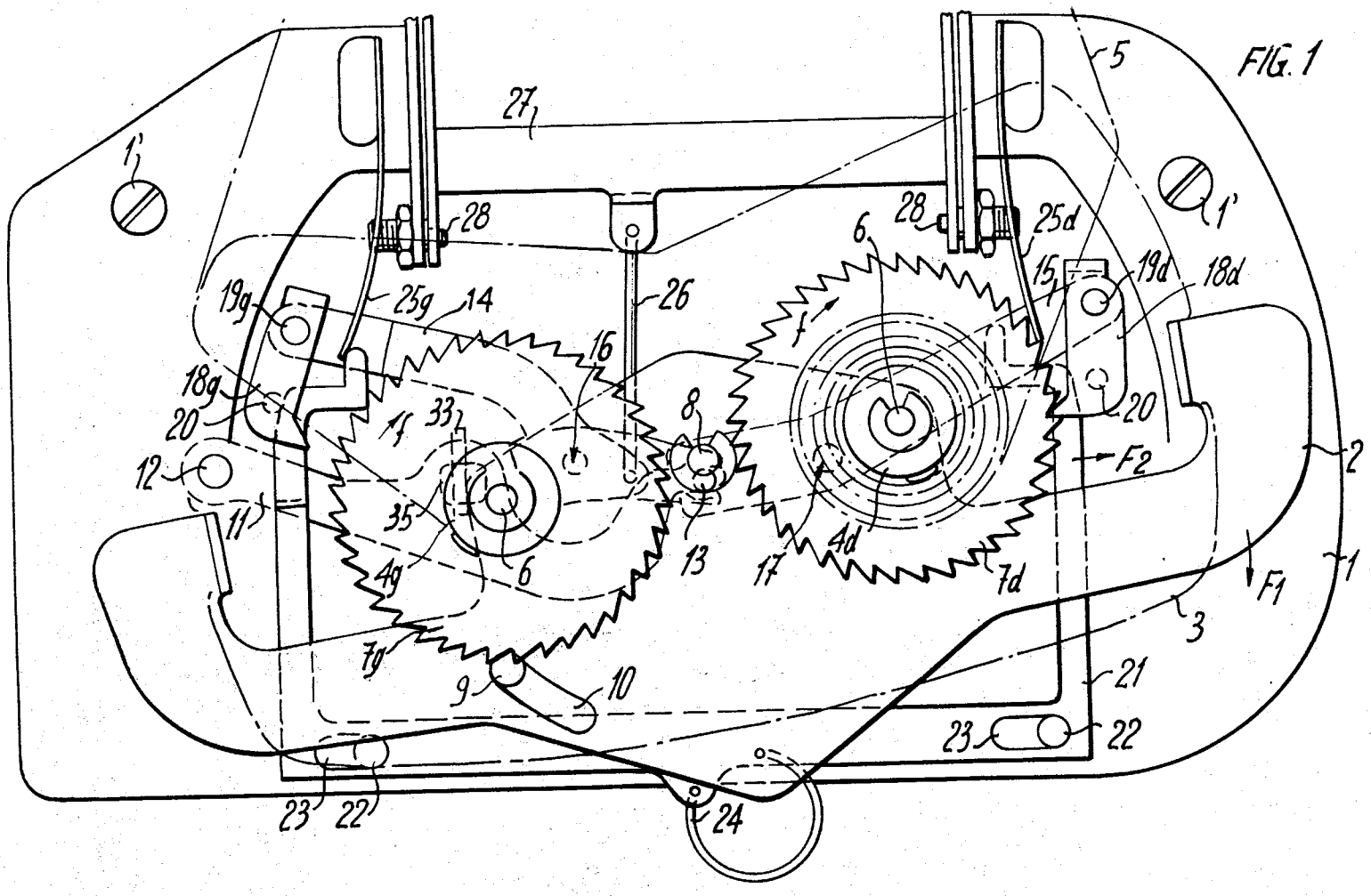

1
2
3
5
6
7d
7g
8
9
10
11
12
13
14
15
16
17
18d
18g
19d
19g
20
21
22
23
24
25d
25g
26
27
28
33
35
4d
4g
F1
F2

TYPEWRITER RIBBON CONVEYING MECHANISM

The invention relates to conveying mechanisms for typewriter ribbons and is particularly concerned with such mechanisms for typewriters of the type including a printing head carriage moving along a platen cylinder and in which the ribbon is enclosed in a cassette.

An object of the invention is to provide a ribbon conveying mechanism with simple means for reversing the direction of drive of the ribbon.

The invention also aims to provide a ribbon conveying mechanism which may be easily and rapidly secured on a printing head carriage, and with which various models of cassette may be employed.

The invention therefore provides, in a typewriter of the type including a printing head carriage movable along a platen cylinder, a ribbon conveying mechanism comprising: a cassette support mounted on the carriage, said cassette support including means for removably securing a cassette enclosing a ribbon which may be alternately wound between two hubs of the cassette, and means for driving the hubs of a cassette secured on the support to drive the ribbon in either direction; means for pivotally mounting said cassette support on the carriage for tipping movement thereof together with a secured cassette between first and second positions; and a member controlling the direction of drive of the hub driving means, said member being actuated in response to tipping movement of the cassette support between its first and second positions to reverse the direction of drive of the ribbon.

Figure 2:
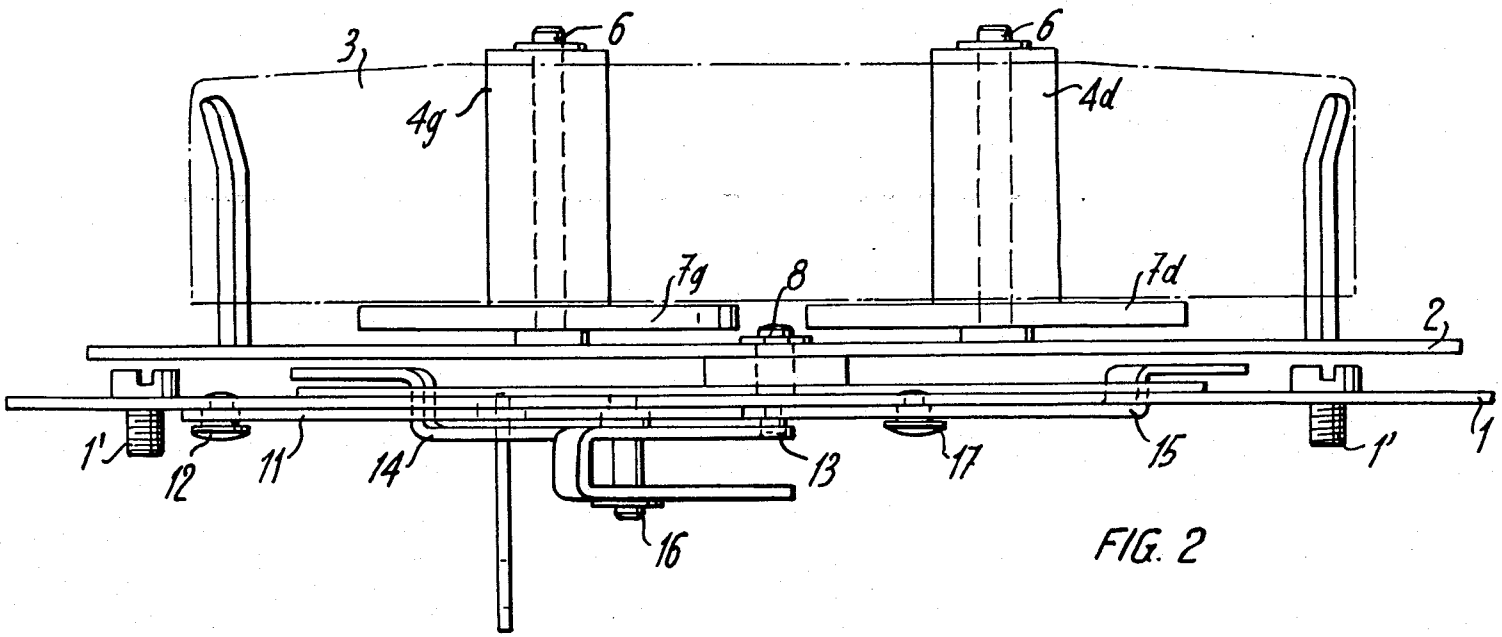
Figure 3:
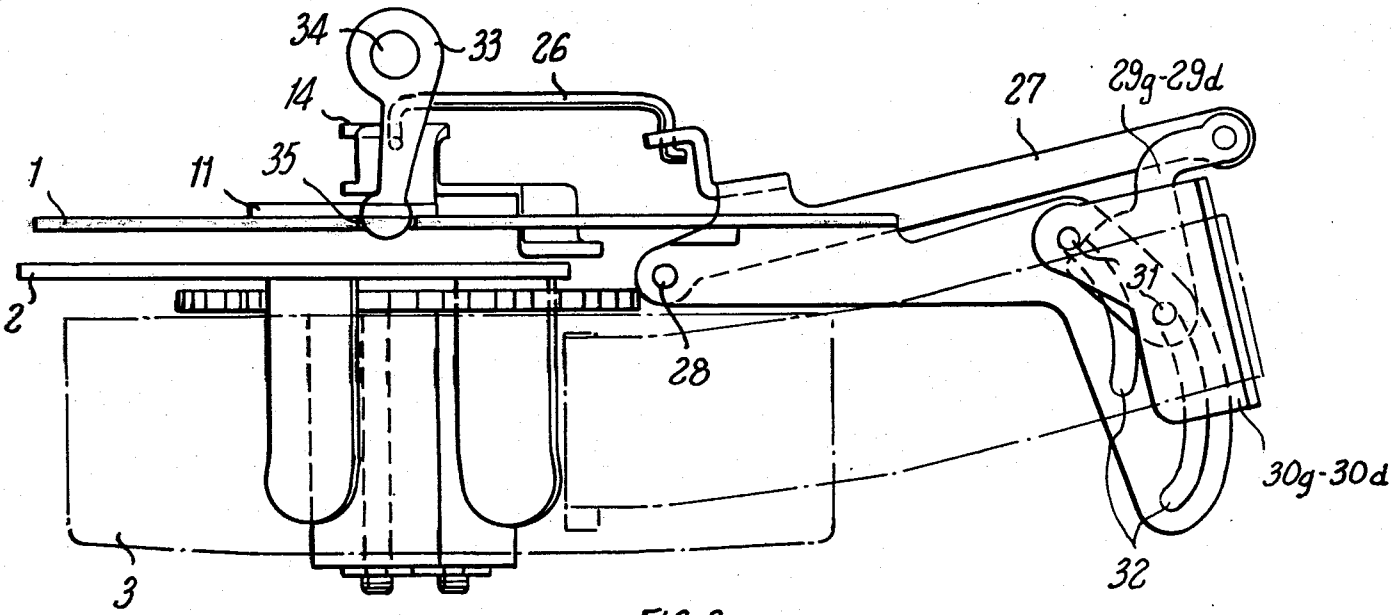

The accompanying drawings show, schematically and by way of example, an embodiment of the mechanism according to the invention. In the drawings:

FIG. 1 is a top plan view of this mechanism together with a cassette shown partly in dotted-dashed lines; and FIGS. 2 and 3 are simplified corresponding front and side elevational views.

The entire ribbon conveying mechanism is supported by a plate 1 secured by means of screws 1′ onto a carriage, not shown, of a typewriter with a printing head. The printing head is carried in the usual manner by the carriage which moves parallel to the platen cylinder of the typewriter.

The mechanism comprises a support 2 for a cassette 3, this support being pivotally mounted about a pivot 8 fixed perpendicular to the centre of plate 1. The support 2 carries two perpendicular rods 6 on which are mounted two toothed wheels 7*g* and 7*d* disposed respectively to the left and to the right of the central pivot 8, looking at FIGS. 1 and 2. The cassette 3 has, in its casing shown in dotted-dashed lines, two hubs 4*g* and 4*d* on which a ribbon is wound, these hubs alternately supplying (i.e. unwinding) or receiving (i.e. rewinding) hubs. The two ends of ribbon 5 are made fast to the hubs which are keyed on rods 6 to be driven by means of the toothed wheels 7*g* and 7*d*, the hubs rotating freely in bearings provided in the cassette casing.

The cassette 3 with its ribbon 5 can thus be placed on the support 2 by means of the two rods 6 which engage respectively in the hubs 4*g* and 4*d*.

Pivoting of the assembly of the support 2 and cassette 3 is limited by a perpendicular pin 9 on plate 1, and which engages inside a slot 10 in the support 2. The pin 9 thus comes to abut at the end of its path against one of the ends of slot 10.

The plate 1 carries a lever 11 pivotally mounted at 12 and having at its free end a perpendicular peg 13 cooperating with two lever arms 14 and 15 respectively pivoted at 16 and 17. These lever arms each carry a driving pawl, 18*g* and 18*d* respectively, pivotally mounted at ends 19*g* and 19*d* of these arms. Pawls 18*g* and 18*d* are able to cooperate with the toothed wheels 7*g* and 7*d* respectively under the action of springs, not shown, which bias the beak of each pawl into engagement with the corresponding teeth of the wheels. Each pawl also has a lateral pin 20 adapted to cooperate with a respective arm of a stirrup piece 21.

The stirrup piece 21 is slidably carried by plate 1 for a limited transverse movement by means of rivets 22 secured in plate 1 and engaging in elongate slots 23 in the stirrup piece 21.

A C-spring 24, fixed at one end to the support 2 and at the other end to the stirrup piece 21 biases the assembly of the support 2 and cassette 3 into either position defined by rod 9.

The plate 1 also carries two flexible blades 25*g* and 25*d* able to engage in the respective teeth of wheels 7*g* and 7*d* to hold them during return of the respective pawl 18*g* and 18*d*. These blades 25*g*, 25*d* can be disengaged from the teeth of wheels 7*g* and 7*d* by a respective end of the arms of stirrup piece 21 when the latter moves along slots 23, i.e. to disengage blade 25*g* when the stirrup piece 21 is to the left, as shown in FIG. 1, and to disengage blade 25*d* when the stirrup piece 21 is to the right.

Also, as shown in FIG. 3, on the lever arm 14 is engaged with a rod 26 which drives a yoke 27 to control lifting movements of the ribbon 5. The yoke 27 is pivotally mounted in flanges of plate 1 at 28 and drives levers 29*g* and 29*d* which in turn drive forks 30*g* and 30*d* for guiding the ribbon 5. These forks are guided by pins 31 engaging in slots 32 in said flanges of plate 1.

The interconnection between the ribbon conveying mechanism and the actuating device, not shown, of the printing head takes place by means of a lever 33 (FIG. 3) which forms part of the printing head and is pivotally mounted at 34. This lever 33, which undergoes a reciprocating movement upon each touch, transmits its movement to lever 11 in which it engages by an opening 35.

The described mechanism operates as follows:

The assembly of support 2 and cassette 3 is initially biased by the spring 24 into the position shown in FIG. 1. In this position, the ribbon 5 unwinds from hub 4*g*, acting as supplying hub, passes through forks 30*g* and 30*d* (FIG. 3), and is wound on the hub 4*d* acting as receiving hub. The toothed wheels 7*g* and 7*d* turn in the direction of arrows *f*. Wheel 7*d* is in mesh with the beak of driving pawl 18*d* which drives the former with an irregular movement corresponding to each touch; this movement is transmitted to lever 11 by lever 33 of the printing head, the lever 11 in turn pivoting the lever arm 15 about pivot 17 and the lever arm 14 about pivot 16. The blade 25*d* is in contact with the teeth of wheel 7*d* and retains it during return of the pawl 18*d*.

The spring 24 also biases the stirrup piece 21 into the left hand position where it contacts pin 20 of pawl 18*g* to simultaneously disengage pawl 18*g* and blade 25*g* from wheel 7*g*.

Moreover, by means of rod 26, lever 11 actuates yoke 27 which, upon each touch, lifts the ribbon 5 by means of levers 29*g* and 29*d* and forks 30*g* and 30*d*.

When the ribbon 5 is fully unwound from the supplying hub 4*g* to which it is made fast, wheel 7*d* and rod 6 can no longer turn because the ribbon can no longer advance. The pawl 18*d* which is still in mesh with the teeth of wheel 7*d* will thus, by acting against this rotationally locked wheel, cause tipping of the assembly of the support 2 and the cassette 3 about the central pivot 8 in the direction of arrow $F_1$. When the support passes the mid-point of its tipping movement, the force exerted by the spring 24 reverses so that the spring 24 exerts its force on the stirrup piece 21 in the opposite direction and causes the rotational movement of the assembly. The stirrup piece 21 thus moves towards the right, in the direction of arrow $F_2$, whereas the support 2 tips clockwise to a position symmetrical to that shown in FIG. 1, its path being limited by abutment of rod 9 against the other end of slot 10. In this position, the pawl 18*g* is no longer disengaged by coaction of its pin 20 with stirrup piece 21, and comes into engagement with the corresponding toothed wheel 7*g*, the stirrup piece 21 at the same time freeing blade 25*g* which also comes to engage with wheel 7*g*. In this position, the lever arm 14 controlled by lever 11 transmits its irregular movement to the pawl 18*g* which, upon each touch, thus drives wheel 7*g* in the direction opposite to arrow *f*. The ribbon 5, fully wound about hub 4*d*, is thus unwound from this hub 4*d* which becomes supplying and is wound up on hub 4*g* which becomes receiving, after having passed through forks 30*d* and 30*g*. A tipping of the assembly of the support 2 and cassette 3 once more takes place, in the opposite direction, when the ribbon 5 becomes fully unwound from the supplying hub 4*d*, whereby hub 4*g* becomes supplying, and so on.

It is seen that in the described mechanism, tipping of the cassette support causes, by simple means, reversal of the direction of movement of the ribbon, this tipping being actuated by the respective pawl 18*g* or 18*d*. It should moreover be noted that the single spring 24 provides two stable positions both of the support-cassette assembly and of the stirrup piece. This spring also accentuates tipping, because during each change of position, it passes through a neutral point where the direction of the force of traction exerted by the spring is reversed.

It should furthermore be noted that the described mechanism is provided as a unit on the plate 1, the only connections with the printing head carriage being the securing means (two screws 1') and the driving means (lever 33 which controls the arm 11). Hence, with this mechanism, it is possible to use cassettes of a different model which can be easily exchanged. The connection with the printer actuating device takes place practically at a single point (lever 33), so that such a mechanism may be easily secured on the typewriter.

I claim:

1. A ribbon conveying mechanism for a typewriter including a printing head carriage, said mechanism comprising a mounting plate, a support mounted on said plate, a cassette mounted on said support, said cassette including a ribbon and two hubs, means for alternately driving each of said hubs to wind the ribbon on the driven hub, said cassette support pivotally mounted for tipping between first and second positions, spring means for biasing the support into either of said first and second positions, said driving means comprising two toothed wheels mounted on said pivotally mounted support, driving pawls cooperating with each of said toothed wheels, connecting means securing each cassette hub to each toothed wheel for rotation therewith, a spring blade for each toothed wheel and cooperating with its related toothed wheel to prevent return movement thereof, control means responsive to the position of said support and engageable with said pawls to render them alternately inoperative, said control means comprising a stirrup member having two arms, said stirrup member being mounted on the carriage for translational movement between a first position in which one arm disengages one driving pawl and the corresponding spring blade from one toothed wheel and a second position in which the other arm disengages the other driving pawl and the corresponding spring blade from the other toothed wheel, wherein the direction of the action of the pawls on said wheels is such that the pawl action on a related wheel rocks said support into a position corresponding to the inoperative position of that particular pawl, and wherein the biasing action of said spring means is greater than the rocking action exerted by the pawl, except when the driven wheel is held immobilized by the ribbon being fully unwound from the other hub.

2. A mechanism according to claim 1 wherein said spring means is connected between the cassette support and the stirrup member to bias the cassette support into either of its first and second positions and simultaneously bias the stirrup piece into a corresponding one of its first and second positions.

3. A mechanism according to claim 2 wherein said spring is shaped and is secured to the cassette support and the stirrup piece in such a manner that the force exerted thereby reverses upon tipping of the cassette support between its first and second positions.

4. A mechanism according to claim 3 including a single member connecting said ribbon conveying mechanism to means for actuating the printing head for transmission of intermittent movements corresponding to actuation of the printing head, and single member being connected to said hub driving means and to ribbon-raising means.

* * * * *